United States Patent [19]

Tabor

[11] Patent Number: 4,807,832

[45] Date of Patent: Feb. 28, 1989

[54] TWO-STRING DELTA-STYLE KITE WITH SAIL CURVATURE CONTROL

[76] Inventor: Donald C. Tabor, 4966 Santa Monica Ave., San Diego, Calif. 92107

[21] Appl. No.: 138,837

[22] Filed: Dec. 28, 1987

Related U.S. Application Data

[63] Continuation-in-part of Ser. No. 73,996, Jul. 16, 1987, which is a continuation of Ser. No. 804,778, Dec. 5, 1985, abandoned.

[51] Int. Cl.[4] ..... B64C 31/06

[52] U.S. Cl. ..... 244/153 R

[58] Field of Search ..... 244/153 R, 154, 155 R, 244/900, 901; D21/88

[56] References Cited

U.S. PATENT DOCUMENTS

| | | | |
|---|---|---|---|
| D. 274,827 | 7/1984 | Belloff | D21/88 |
| 3,241,793 | 3/1966 | Curtis et al. | 244/153 R |
| 3,347,500 | 10/1967 | Hartig | 244/153 R |
| 3,801,052 | 4/1974 | Quercetti | 244/153 R |
| 3,994,454 | 11/1976 | Worsham | 244/153 R |
| 4,286,762 | 9/1981 | Prouty | 244/153 R |

FOREIGN PATENT DOCUMENTS 2854939 7/1980 Fed. Rep. of Germany ..... 244/901

OTHER PUBLICATIONS

"Penguin Book of Kites", David Pelham, 1976, p. 199.

*Primary Examiner*—Galen Barefoot
*Assistant Examiner*—Lynn M. Fiorito
*Attorney, Agent, or Firm*—Brown, Martin, Haller & Meador

[57] ABSTRACT

An easily assembled, steerable two-string kite suitable for sailing in light or strong winds having curvature adjusting and maintaining wing members with passed flexible rods to maintain the curvature, a substantially v-shaped frame made of lightweight material and covered with flexible sail material, capable of in-flight maneuvers including maintaining constant speed over a wide angle relative to the ground, direct overhead flight, 90-degree turns relative to the center of the kite, and lift-off from the ground, all without need to adjust or alter the position of the strings affixed to the kite.

14 Claims, 4 Drawing Sheets

TWO-STRING DELTA-STYLE KITE WITH SAIL CURVATURE CONTROL

CROSS-REFERENCE TO RELATED APPLICATION

This application is a continuation-in-part of my copending application Ser. No. 07/073,996, filed July 16, 1987, which in turn is a continuation of my previous application Ser. No. 06/804,778, filed Dec. 5, 1985, and now abandoned.

BACKGROUND OF THE INVENTION

A variety of kites are presently commercially available for recreational purposes or for the use by the serious competitor aiming to excel at competition kite-sailing. Depending on the design of a particular kite and the materials used to construct it, it may be flown in light or moderate winds and maneuvered to exhibit aerial feats of different degrees of difficulty.

Kites generally fall into two broad categories: those that are flown with a single string and those flown with two strings affixed to the kite. A variety of single-string kites are well-known, including the Chinese kite, barrel kite, Malay kite, Marconi-jib kite and Indian-fighter kite. While there are significant differences in the wind speed single-string kites can be flown at, as well as the type of maneuvers each can perform, it is generally true that they perform best in low to moderate winds and are incapable of exhibiting radical maneuvers such as direct overhead flight and dramatic turns accompanied by nearly parallel flight to the ground. Because of the limited weather conditions and limited maneuverability in which single-string kites can be flown, two-string kites that exhibit a wide range of desirable properties have been accepted among kite enthusiasts.

As is apparent from the name, a primary feature of two-string kites is the attachment of two strings of equal length to the kite, one to the right and left sides of the kite, respectively. By pulling on either of strings the kite enthusiast can put a two-string kite through exceptional maneuvers. Indeed, the maneuverability of two-string kites is due to constant adjustment of the tension on the string. When tension is applied to either the right or left string, the kite responds by moving in the corresponding direction. If tension is continuously applied evenly on one string, the kite turns continuously in that direction. For example, a clockwise spin is imparted to the kite by pulling in on the right string and stopped by subsequently pulling in on the left string. Be exerting even tension on both lines after a particular line of flight is established, the direction of flight can be maintained. Thus, a variety of aerial maneuvers can be performed by the sequence in which the operator pulls on the right and left strings.

A feature that distinguished single-string from dual-string kites is the flight angle of attack. Single-string kites fly at a substantially fixed angle of attack to the ground, whereas dual-string kites exhibit a variable angle of attack. When the angle of attack is great, a dual-sting kite is capable of obtaining high speeds and performing rapid turns.

Several dual-string kites are presently commercially available with names that adequately describe their aerial maneuverability, for example Sky Cat, Sky-Ro-Gyro and Super Stuntor.

In my copending U.S. patent application Ser. No. 07/073,996 and its parent application Ser. No. 06/804,778, I have described and claimed a steerable two-string kite suitable for sailing in variable winds. This kite contains flexible support members for adjusting the curvature of its sail during flight in reaction to the force of the wind so as to enhance its maneuverability. Its ability to adjust curvature of the sail allows this kite to perform many flying maneuvers in a manner superior to previous kites. These include maintaining constant speed over a wide range of angles relative to the ground, direct overhead flight and 90-degree turns relative to the center of the kite, all without the need to adjust or alter the position of the strings affixed to the kite. The superiority of this prior kite has been established in a number of professional kite flying competitions which competitors using this kite have won.

It has been found with the prior kite that it is usually advantageous to maintain the sail curvature under a variety of wind and flight conditions. However, with the structure of the prior kite that has not always been possible. For instance, in right wind conditions, the force of the wind on the kite may not be sufficient to cause the curvature of the sail to develop. A similar challenge exists when the flight path of the kite is parallel to the wind direction, as in direct overhead or 90-degree positions relative to the kite flyer. Under such conditions, the maneuverability of the kite is found to decrease. Typically it is found that the sail begins to flutter, causing the kite to lose stability, turn over and float to the ground.

The problem cannot be overcome by simply forming the sail into a curved shape with a rigid brace, for that prevents the sail from varying its curvature under different wind conditions, which is of course an important feature of the kite. It would therefore be of significance to have a kite structure which would retain the advantageous ability to vary curvature as my prior kite can, but which would also allow the sail to retain the varying curvatures and not lose its shape during flying.

SUMMARY OF THE INVENTION

In its broadest form, the invention herein is a stunt kite suitable for sailing in variable winds which comprises: a sail of flexible material;

a substantially V-shaped frame covered by the sail and formed by an outer pair of rods connected at one end to form a point and extending to an connected to the rear of the sail;

a central rod intermediate the outer pair of rods, connected thereto at the point of the frame and extending to and connected to the rear of the sail, the outer pair of rods extending rearwardly beyond the central rod;

a middle pair of rods connected to the frame at the point thereof, each rod of said middle pair disposed intermediate the central rod and one of the rods of the outer pair and extending to and connected to the rear of the sail, and extending rearwardly beyond the central rod;

a pair of horizontal rods arranged in fore and aft relationship and connected at opposite ends to the outer pair of rods, with an aft horizontal rod also connected at its midpoint to the rear of the central rod, at least the aft horizontal rod being capable of substantial in-flight arcuate flexibility;

means for providing directional control; and a pair of flexible rods disposed on opposite sides of the central rod, with each of the flexible rods assuming a curved shape and connected at one end to the aft horizontal rod at a point on the aft horizontal rod generally centrally intermediate the central rod and the respective one of the outer pair of rods and connected at the other end to the end of the respective one of the middle pair of rods.

In another form, the invention herein is an improvement in a stunt kite suitable for sailing in variable winds, which kite comprises a sail of flexible material; a substantially V-shaped frame covered by the sail and formed by an outer pair of rods connected to the rear of the sail; a central rod intermediate the outer pair of rods, connected thereto at the point of the frame and extending to and connected to the rear of the sail, the outer pair of rods extending rearwardly beyond the central rod; a middle pair of rods connected to the frame at the point thereof, each rod of the middle pair disposed intermediate the central rod and one of the rods of the outer pair and extending from the front and connected to the rear of the sail, and extending rearwardly beyond the central rod; a pair of horizontal rods arranged in fore and aft relationship and connected at opposite ends to the outer pair of rods, with the aft horizontal rod also connected at its midpoint to the rear of the central rod, at least the aft horizontal rod being capable of substantial in-flight arcuate flexibility; and means for providing directional control; in which the improvement comprises:

a pair of flexible rods disposed on opposite sides of the central rod, with each of the flexible rods assuming a curved shape and connected at one end to the aft horizontal rod at a point on the aft horizontal rod generally centrally intermediate the central rod and the respective one of the outer pair of rods and connected at the other end to the end of the respective one of the middle pair of rods.

DETAILED DESCRIPTION OF THE INVENTION

Figure 1:
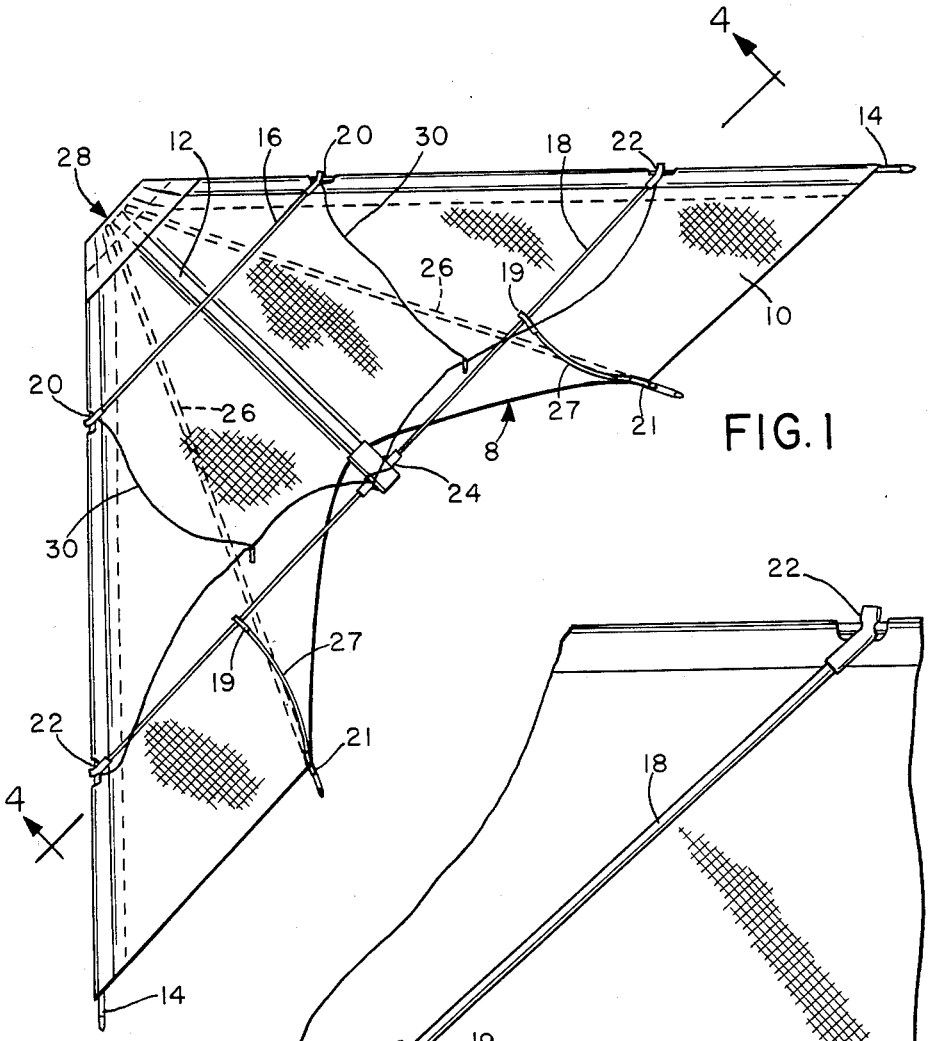
FIG. 1 shows the two-sting kite of this invention viewed from the underside.
Figure 1A:
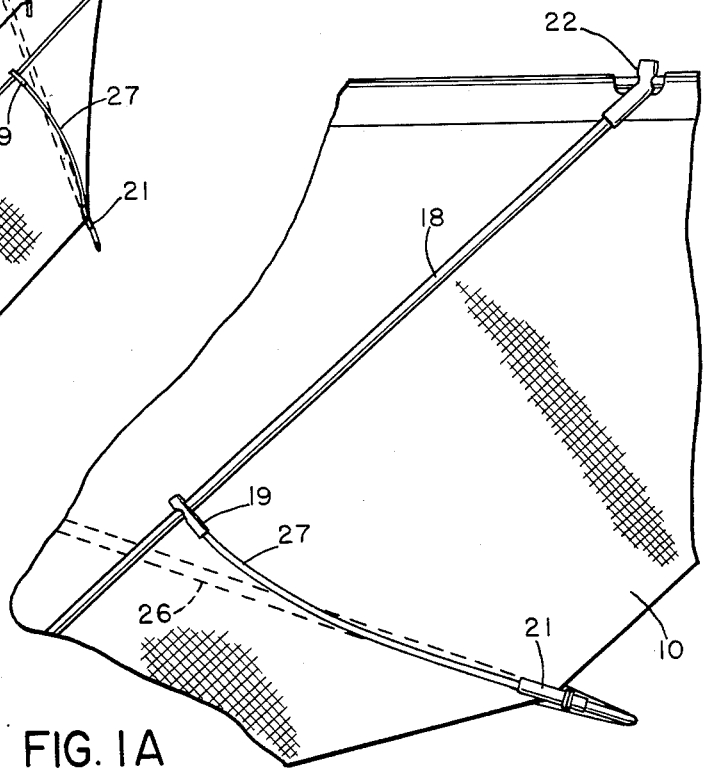
FIG. 1A is an enlargement of a portion of FIG. 1 showing one of the curved rods which connects a middle rod to the rear-most (aft) horizontal member.

Referring now to FIG. 1, the kite is shown to comprise a wing or sail 8 of flexible material 10 that is arranged across a supporting substantially flexible V-shaped frame comprising a fore and aft central support rod ("spine") 12 connected with the foremost and rearmost edge portions of the cover to limit the upward movement of the longitudinally central portion of the cover, and lateral or outer frame rods ("loading edge rods") 14 connected respectively with the lateral edge portions of the cover and so arranged with relation to the central fore and aft frame rod as to permit the lateral portions of the cover between the lateral frame rod and the central support rod of the cover to move upwardly between these rods when the kite is in flight. Additionally, the frame has two parallel horizontal crossbars ("top horizontal spreader") 16 and ("bottom horizontal spreader") 18 placed at different distances from the nose of the frame and that are connected at points 20 and 22 to the outer rod. The rearmost or aft horizontal rod 18, in addition to being connected to the outer rods, is also connected to a fitting ("center tree") 24 to the central support rod at about the midpoint of the horizontal rod. The frame has two middle rods ("bottom rods") 26 that connect to the nose 28 of the kite and extend rearward with each being situated between an outer rod and the central support rod. The nose of the kite 28 receives the central support rod, outer rods, and the middle rods and is substantially flat at its end. Two strings are affixed to the kite by a bridle 30. In flight the nose curls inward catching the wind and provides or increases the maneuverability of the kite. To this extent, the structure so described is identical to the structure of my prior kite claimed in aforesaid U.S. patent application Ser. Nos. 06/804,778 and 07/073,996.

In the present invention, the structure is significantly improved in its flight stability characteristics and ability to maintain a stable sail curvature by the inclusion of a pair of curved rods ("whickers") 27 connecting the two middle rods 26 at their generally rearward portion to the rearward horizontal rod 18 at about the midpoints 19 between fitting 24 on the central support rod 12 and point 22 on the two outer frame rods 14.

The central support rod is connected to the nose of the kite 28 by contact with a fitting formed from reinforced flight material; particularly useful are synthetic polyester textile materials, an example being Dacron® polyester. At the rear, the central support rod is connected to the aft horizontal rod by means of a fitting 24 formed preferably of vinyl or aluminum tubing. Like suitable materials may also be used. In addition to receiving the central support rod, the rear fitting 24 receives the inner ends of two segments forming the rearmost horizontal support rod 18 and thereby supports the central support rod.

Figure 2:
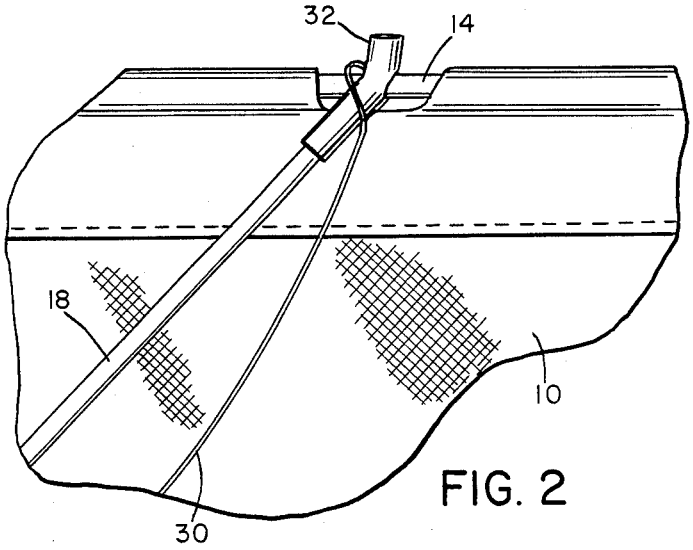
FIG. 2 shows attachment of a horizontal rod to an outer rod by fitting into plastic tubing connected to the outer rod.

The parallel horizontal crossbars 16 and 18 provide lateral support to the V-shaped frame and can be made of lightweight flexible materials. The horizontal crossbar closest to the nose 16 attaches to the outer rod by any of several commonly used fittings that yieldable resist the movement of the fitting in the rod and retains the same in adjusting positions thereon. As shown in FIG. 2, it is convenient to employ plastic tubing or material made of soft rubber 32 with a hole of an approximate diameter the size of the crossbar and capable of receiving the same. Whereas the fitting can be attached to the outer rods in several ways, it is preferable to form a longitudinal bore through the plastic fitting and slide it down the latter rod to the desired distance from the front of the kite.

Figure 3:
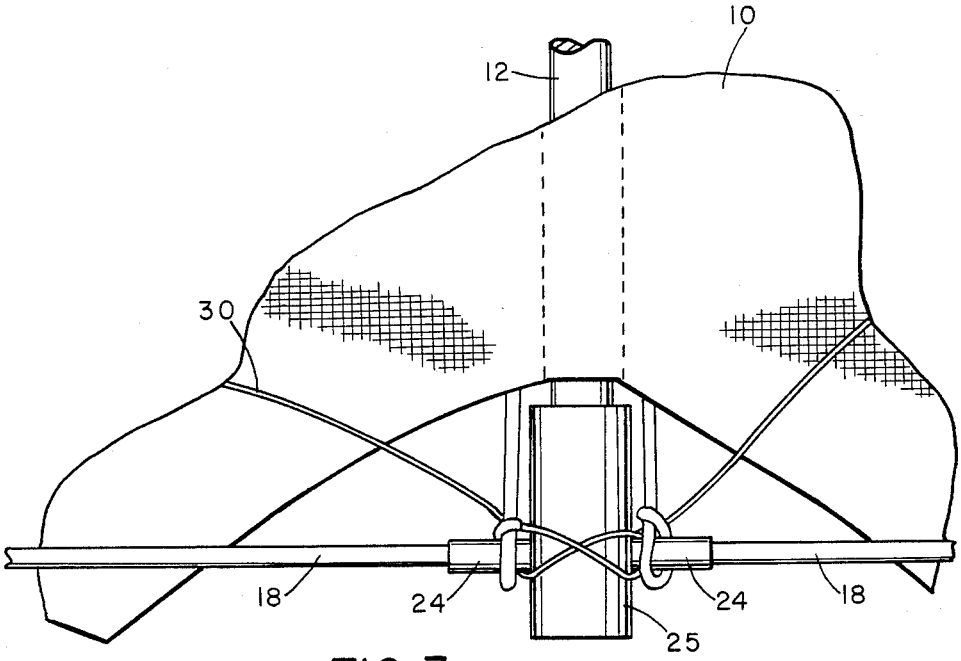
FIG. 3 shows the central support rod attached to the rearmost horizontal rod by mutual attachment to a fitting.

As shown, the horizontal crossbar farthest from the nose of the kite 18 in its preferred embodiment is formed in two sections which may be disconnected from fitting 24, which allows the kite to be readily folded and transported. Each section is connected to its outer rod independent of the other using fittings as described for the crossbar closest to the nose. Additionally, each section connects to the central support rod, as shown in FIG. 3, by sliding into fitting 24 attached to the central support member by means of a piece of tubing 25.

The curved rods 27 are each attached at one end to a fitting 21 at the generally rearward portion of the middle rod 26, and, at the other end, to a similar fitting 19 located at or near the midpoint of the aft horizontal rod between the central and outer support members. The curved rods are made of lightweight flexible material, which will preferably be solid thin fiberglass. The fittings for attaching them preferably can be made of plastic or soft rubber tubings similar to those used for connecting the horizontal rods the outer rods.

Apart from the covered members 27, the various rods of this invention can be made of any convenient lightweight flexible material, such as fiberglass, wood or plastic. Preferred are hollow fiberglass rods, such as those sold under the trademark "Arrowshaft." Generally the central rod will be of the greatest diameter, and therefore the stiffest, while the outer and middle rods will be of lesser diameter and more flexible and the horizontal rods will be still thinner and more flexible.

Figure 4A:
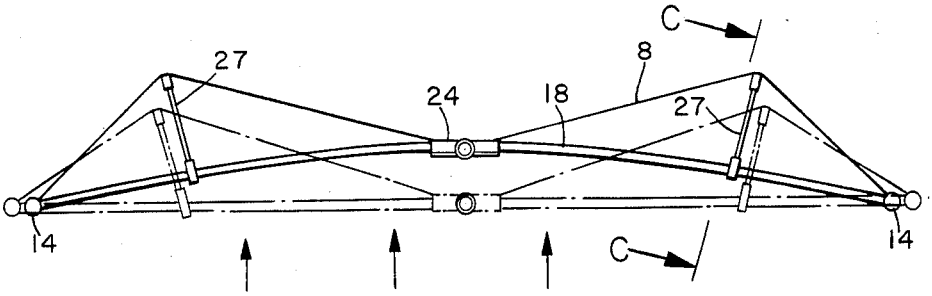
FIG. 4A is a cross-sectional view of the kite taken on line 4—4 of FIG. 1 showing the rearmost horizontal rod and the cover at minimum and low deflection positions.
Figure 4B:
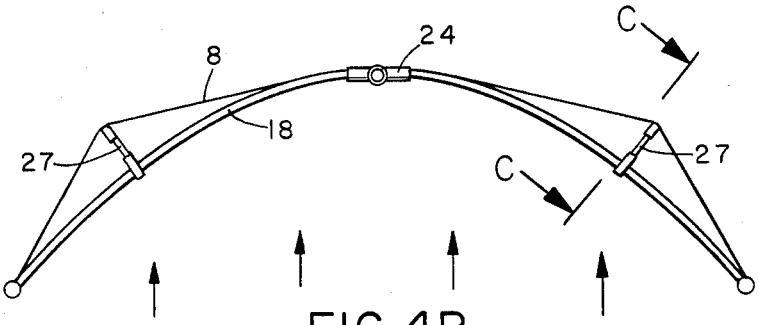
FIG. 4B is a view of the kite similar to that in FIG. 4A but showing a high deflection.
Figure 4C:
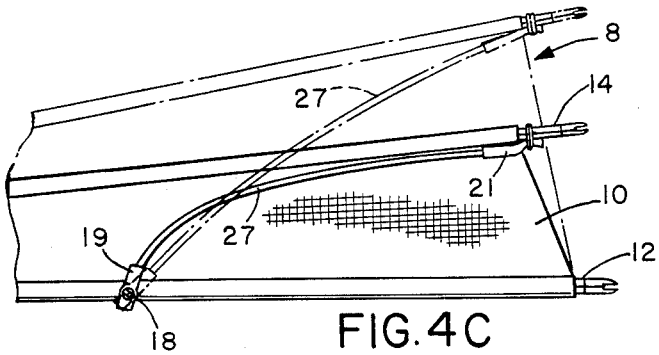
FIG. 4C is a view in the direction of arrows C—C in FIGS. 4A and 4B.

The high maneuverable characteristics of the kite are attributable to the capacity of the sail to flex and to maintain its curvature. This capacity derives from the combined ability of the rearmost horizontal bar and the curved rods to flex and establish suitable sail curvatures in flight (FIGS. 4A, 4B and 4C). The degree of flex and the curvature of the sail depend on the force of the wind on the surface of the sail. For example, FIG. 4 depicts two sail flex positions; when the kite is stationary, or travels in a direction parallel to the direction of the wind, where there is minimal wind force normal to the surface of the sail 8, the rearward horizontal member 18 assumes little or no flex. Under such condition, the curvature of the sail 8 is maintained by the flexible curved rods 27 to enhance the kite's maneuverability and stability. As the speed and the force of the wind increase, the rearmost horizontal bar 18 begins to flex causing both the flexible curved rods 28 and the sail 8 to move upward. FIG. 4B shows the kite with a high degree of flex when subject to greater wind force. Under this situation, the curvature of the individual sail members becomes less, and the curved rods 27 flex to a greater degree of curvature to compensate for the flattened curvature of the sail 8, as shown in FIG. 4C. It will be evident from these Figures that the rods 27 must be curved and flexible; if the rods 27 were straight or inflexible they would penetrate the sail material 10 when the sail 8 curved and would damage or destroy the sail 8.

The use of the fittings that allow either crossbar to be easily inserted and removed permits the kite to be folded and easily packaged for transport. This procedure is rapid and enables the user to assemble and launch a kite rapidly after removing the kite from its protective sheath.

Figure 5:
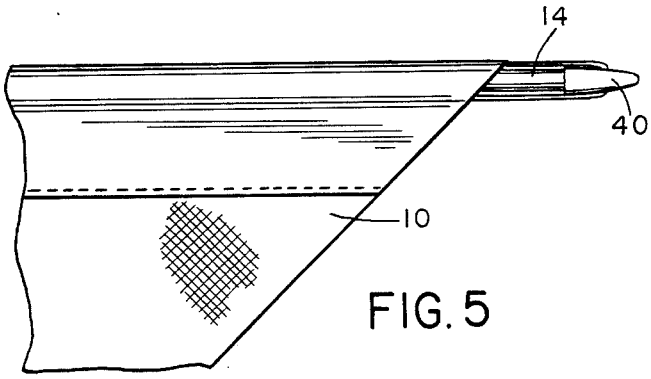
FIG. 5 shows an outer rod attached to the sail material by elastic material connecting the sail material to a notch in the rod.
Figure 6:
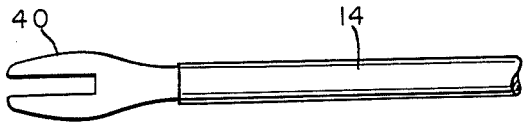
FIG. 6 shows a rod with a notch.

The middle rods are attached to the nose of the kite between the central support and outer rods and are also attached at the rear by connection to kite sail material 10. Such connections can be effected by string, elastic bands, grommets or other suitable means attached to the kite sail material and the middle rods. Similar connections are made with the outer rods 14. As shown in FIGS. 5 and 6, it is convenient to make these connections by means of a slot 40 formed in the ends of the rods, as illustrated for rods 14.

Figure 7:
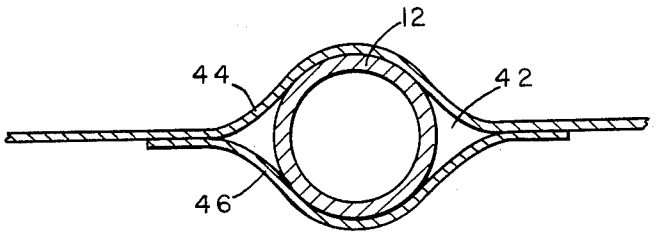
FIG. 7 shows the central rod situated inside a tunnel created by two layers of sail material.

In order to restrain the central support rods, outer rods and middle rods to maintain a set position while the kite is in flight, as depicted in FIG. 7 for the central rod 12, the rods are situated inside a tunnel 42 made of two layers 44 46 of kite material. This can be accomplished by stitching or gluing the two layers together to form a tunnel of a diameter equal to that of the rods that occupy it.

The lengths of the central, outer and middle rods, the angles that separate them, and the distance of the parallel horizontal crossbars from the nose establish the limits of the kite's aerial maneuverability. Generally, it is anticipated that the most used version of the kite will have a central rod 28"–34" long, outer rods 63"–69" long and middle rods 49"–55" long. Usually the length of the central rod will be 9.4–0.6 times the length of each outer rod and 0.5–0.7 times the length of each middle rod. The horizontal cross bars will generally be spaced 11"–17" and 42"–48" from the nose and will generally be 20"–26" and 62"–69" long, respectively. The flexible curved rods will have a length of 15"–20". It will be understood to one skilled in the art that kites of any size can be constructed provided the dimensions are scaled up or down accordingly.

Figure 8:
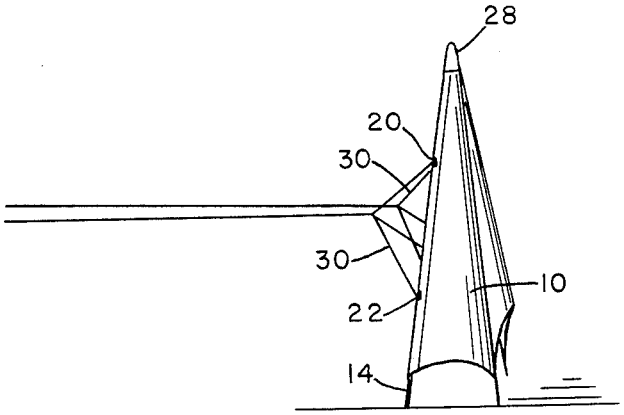
FIG. 8 shows the kite standing on the tips of the rods in the launch position.

In the assembly of the kite preparatory to flight, the parallel horizontal crossbars are inserted into the fittings situated on the outer members. The horizontal crossbar nearest the nose is inserted in a single step requiring insertion only into fittings on the outer rods. The crossbar farthest from the nose, being in two parts, requires that each part be inserted into fittings on both the outer rods and on the central support rod. Next, the flexible curved rods are inserted into the fittings on the middle rods and on the rearmost horizontal rod. A bridle is attached (usually permanently) to the kite at the region where the horizontal crossbars contact the outer rods and the rear of the central support member. Next, two strings or other suitable material of sufficient strength to hold the kite aloft are attached at points on the bridle. FIG. 8 shows that the kite can be launched directly from the ground, without the aid of a person to hand-launch it, by standing it on the tips of the outer frame members. When supported by the air, the upper pressure of the air on the cover moves the lateral portions thereof upwardly between the fore and aft frame members. When supported by the air, the upper pressure of the air on the cover moves the lateral portions thereof upwardly between the fore and aft frame members forcing the cover a minimum distance of 6"–9" near the midpoint of the two middle rods.

We claim:

1. A stunt kite suitable for sailing in variable winds which comprises:

a sail of flexible material;

a substantially V-shaped frame covered by said sail and formed by an outer pair of rods connected at one end to form a forward point of said frame extending to and connected to the rear of said sail;

a central rod intermediate said otter pair of rods, connected thereto at said forward point of said frame and extending to and connected to the rear of said sail, said outer pair of rods extending rearwardly beyond said central rod;

a middle pair of rods connected to said frame at said forward point thereof, each rod of said middle pair disposed intermediate said central rod and one of the rods of said outer pair and extending to and connected to the rear of said sail, and extending rearwardly beyond said central rod;

a pair of horizontal rods arranged in fore and aft relationship and connected at opposite ends to said outer pair of rods, with the aft horizontal rod also connected at its midpoint to the rear of said central rod, said aft horizontal rod being capable of substantial in-flight arcuate flexibility;

means for providing directional control; and a pair of flexible rods disposed on opposite sides of said central rod, with each of said flexible rods assuming a curved shape and connected at one end to said aft horizontal rod at a point on said aft horizontal rod generally centrally intermediate said central rod and said respective one of said outer pair of rods and connected at the other end to the rear end of said respective one of said middle pair of rods.

2. A kite as in claim 1 wherein said flexible material is polyester textile fiber.

3. A kite as in claim 1 wherein said central, middle and outer rods are made of fiberglass, wood or plastic.

4. A kite as in claim 1 wherein said curved rods are made of solid thin fiberglass.

5. A kite as in claim 1 wherein said central rod is connected to the front of said V-shaped frame by attaching said central rod at the point of the front of said V-shaped frame.

6. A kite as in claim 1 wherein said central rod is connected to the rear of said frame by attachment to the aft member of said pair of said horizontal rods.

7. A kite as in claim 1 wherein said central rod is about 0.4–0.6 times as long as each of said pair of outer rods.

8. A kite as in claim 7 wherein said central rod is about 0.5–0.7 times as long as each of said middle pair of rods.

9. A kite as in claim 1 wherein said pair of horizontal rods are arranged in a parallel relationship from the front of said kite are about 11″–17″ and 42″–48″ from the front of said kite, respectively.

10. A kite as in claim 1 wherein said means providing directional control is a bridle attached to said frame.

11. A kite as in claim 10 wherein said means providing directional control comprises a bridle contacting said kite at or near the point of contact of said two horizontal rods with said two outer rods and at or near the rear of said central support rod.

12. A kite as in claim 1 wherein said aft horizontal rod comprises two substantially equal-size sections.

13. A kite as in claim 12 wherein said aft horizontal rod attaches to said central support rod by connecting said sections to the rear of said central support rod.

14. In a stunt kite suitable for sailing in variable winds, which kite comprises a sail of flexible material; a substantially V-shaped frame covered by said sail and formed by a outer pair of rods connected at one end to form a forward point of said frame and extending rearwardly to and connected to the rear of said sail; a central rod intermediate said outer pair of rods, connected thereto at said forward point of said frame and extending to and connected to the rear of said sail, said outer pair of rods extending rearwardly beyond said central rod; a middle pair of rods connected to said frame at said forward point thereof, each rod of said middle pair disposed intermediate said central rod and one of the rods of said outer pair and extending from said forward point and connected to the rear of said sail, and extending rearwardly beyond said central rod; and a pair of horizontal rods arranged in fore and aft relationship and connected at opposite ends to said outer pair of rods, with the aft horizontal rod also connected at its midpoint to the rear of said central rod, at least said aft horizontal rod being capable of substantial in-flight arcuate flexibility; and means for providing directional control; the improvement which comprises:

a pair of flexible rods disposed on opposite sides of said central rod, with each of said flexible rods assuming a curved shape and connected at one end to said aft horizontal rod at a point on said aft horizontal rod generally centrally intermediate said central rod and the respective one of said outer pair of rods and connected at the other end to the rear end of the respective one of said middle pair of rods.

* * * * *

UNITED STATES PATENT AND TRADEMARK OFFICE

CERTIFICATE OF CORRECTION

PATENT NO. : 4,807,832

DATED : February 28, 1989

INVENTOR(S) : Dorald C. Tabor

It is certified that error appears in the above-identified patent and that said Letters Patent is hereby corrected as shown below:

The inventor's name "Donald C. Tabor" should be --Dorald C. Tabor--; and

Claim 1, column 7, line 1, "otter" should be --outer--;

Signed and Sealed this

Sixth Day of February, 1990

*Attest:*

JEFFREY M. SAMUELS

*Attesting Officer*

*Acting Commissioner of Patents and Trademarks*